US008982164B2

(12) United States Patent
Pyo

(10) Patent No.: US 8,982,164 B2
(45) Date of Patent: Mar. 17, 2015

(54) METHOD OF COMPENSATING GAMMA REFERENCE VOLTAGES, AND GAMMA REFERENCE VOLTAGE COMPENSATION CIRCUIT

(75) Inventor: Si-Baek Pyo, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 415 days.

(21) Appl. No.: 13/463,213

(22) Filed: May 3, 2012

(65) Prior Publication Data

US 2013/0169693 A1 Jul. 4, 2013

(30) Foreign Application Priority Data

Dec. 29, 2011 (KR) ..... 10-2011-0145728

(51) Int. Cl.
*G09G 5/10* (2006.01)
*G09G 3/32* (2006.01)

(52) U.S. Cl.
CPC ..... *G09G 3/3225* (2013.01); *G09G 2320/0606* (2013.01); *G09G 2320/064* (2013.01); *G09G 2320/0666* (2013.01); *G09G 2330/028* (2013.01)
USPC ..... 345/690; 345/76; 345/77; 345/212

(58) Field of Classification Search
CPC . G09G 3/3233; G09G 3/3406; G09G 3/3413; G09G 2320/0233; G09G 2360/16; G09G 2300/0866; G09G 2320/0276; G09G 2320/0613; G09G 3/3208; G09G 2330/028; G09G 3/3225
USPC ..... 345/76, 212, 690
See application file for complete search history.

(56) References Cited

U.S. PATENT DOCUMENTS

| | | | | |
|---|---|---|---|---|
| 2007/0115209 | A1* | 5/2007 | Maejima | 345/46 |
| 2009/0109165 | A1* | 4/2009 | Park et al. | 345/102 |
| 2009/0284452 | A1* | 11/2009 | Takata et al. | 345/77 |
| 2009/0284453 | A1 | 11/2009 | Shin et al. | |
| 2010/0060204 | A1* | 3/2010 | Ohtake et al. | 315/307 |
| 2011/0141090 | A1* | 6/2011 | Hong et al. | 345/211 |

FOREIGN PATENT DOCUMENTS

| | | | |
|---|---|---|---|
| KR | 10-2008-0032275 | A | 4/2008 |
| KR | 10-2009-0118225 | A | 11/2009 |
| KR | 10-2011-0067620 | A | 6/2011 |

* cited by examiner

*Primary Examiner* — Amare Mengistu
*Assistant Examiner* — Gloryvid Figueroa-Gibson
(74) *Attorney, Agent, or Firm* — Lee & Morse, P.C.

(57) ABSTRACT

In a method of compensating gamma reference voltages includes setting a plurality of emission signal on-duty ratios that have different values in a range from 0% to 100%, setting a plurality of data offsets for the emission signal on-duty ratios and each of the data offsets being set based on a color shift, the color shift being caused according to the emission signal on-duty ratios, generating a plurality of compensation gamma reference voltages by multiplying a gamma reference voltage by the data offsets, and applying the compensation gamma reference voltages to an organic light emitting display panel in dimming ranges that include the emission signal on-duty ratios, respectively.

16 Claims, 12 Drawing Sheets

METHOD OF COMPENSATING GAMMA REFERENCE VOLTAGES, AND GAMMA REFERENCE VOLTAGE COMPENSATION CIRCUIT

CROSS-REFERENCE TO RELATED APPLICATION

Korean Patent Application No. 2011-0145728, filed on Dec. 29, 2011, in the Korean Intellectual Property Office (KIPO), is incorporated by reference herein in its entirety.

BACKGROUND

An overall luminance of a liquid crystal display (LCD) device may be controlled by controlling a quantity of light based on a magnitude of a voltage that enters into a lamp. However, it is may be challenging to control the overall luminance of an organic light emitting display (OLED) panel because an active matrix type organic light emitting display (AMOLED) device uses self-emitting materials.

SUMMARY

Embodiments may be realized by providing a method of compensating gamma reference voltages that includes setting a plurality of emission signal on-duty ratios that have different values in a range from 0% to 100%, setting each data offset for the emission signal on-duty ratios based on each color shift, the each color shift being caused according to the emission signal on-duty ratios, generating a plurality of compensation gamma reference voltages by multiplying a gamma reference voltage by the each data offset for the emission signal on-duty ratios, and applying the compensation gamma reference voltages to an organic light emitting display (OLED) panel in dimming ranges that include the emission signal on-duty ratios, respectively.

The emission signal on-duty ratio may be a ratio of an 'on' period of an emission signal to a period corresponding to one frame, the emission signal on-duty ratio being proportional to a luminance of the OLED panel. A magnitude of the each color shift may be greater as the emission signal on-duty ratio is smaller.

The each data offset for the emission signal on-duty ratios may include a red data offset for a red color, a green data offset for a green color, and a blue data offset for a blue color. The red data offset, the green data offset, and the blue data offset may be determined based on a magnitude of the color shift of the red color, a magnitude of the color shift of the green color, and a magnitude of the color shift of the blue color, respectively.

The dimming ranges may be selected based on the luminance of the OLED panel. The emission signal on-duty ratios may include a first on-duty ratio and a second on-duty ratio, the second on-duty ratio being smaller than the first on-duty ratio.

The step of generating the compensation gamma reference voltages may include a step of generating a first compensation gamma reference voltage by multiplying the gamma reference voltage by a data offset for the first on-duty ratio, and a step of generating a second compensation gamma reference voltage by multiplying the gamma reference voltage by a data offset for the second on-duty ratio.

An absolute value of the data offset for the second on-duty ratio may be greater than an absolute value of the data offset for the first on-duty ratio. The step of setting the each data offset may include a step of setting a data offset for the second on-duty ratio, and a step of obtaining a data offset for the first on-duty ratio by multiplying the data offset for the second on-duty ratio by a constant factor that is inversely proportional to a magnitude of the emission signal on-duty ratio.

Embodiments may also be realized by providing a method of compensating gamma reference voltages that includes a step of setting a first emission signal on-duty ratio, a second emission signal on-duty ratio, and a third emission signal on-duty ratio that have different values in a range from 0% to 100%, the value of the first emission signal on-duty ratio being greater than the value of the second emission signal on-duty ratio, the value of the second emission signal on-duty ratio being greater than the value of the third emission signal on-duty ratio, a step of setting each data offset for the first through third emission signal on-duty ratios based on each color shift, the each color shift being caused according to the first through third emission signal on-duty ratios, a step of obtaining an average data offset by calculating an average of the each data offset, a step of generating a first compensation gamma reference voltage corresponding to the first emission signal on-duty ratio by multiplying a gamma reference voltage by the average data offset, a step of generating a second compensation gamma reference voltage corresponding to the second emission signal on-duty ratio by multiplying the first compensation gamma reference voltage by the average data offset, a step of generating a third compensation gamma reference voltage corresponding to the third emission signal on-duty ratio by multiplying the second compensation gamma reference voltage by the average data offset, and a step of applying the first through third compensation gamma reference voltages to an organic light emitting display panel in dimming ranges that include the first through third emission signal on-duty ratios, respectively.

A magnitude of the color shift for the first emission signal on-duty ratio may be smaller than a magnitude of the color shift for the second emission signal on-duty ratio, and the magnitude of the color shift for the second emission signal on-duty ratio may be smaller than a magnitude of the color shift for the third emission signal on-duty ratio.

The gamma reference voltage may be greater than the first compensation gamma reference voltage, the first compensation gamma reference voltage may be greater than the second compensation gamma reference voltage, and the second compensation gamma reference voltage may be greater than the third compensation gamma reference voltage.

The second compensation gamma reference voltage may be generated based on the first compensation gamma reference voltage, and the third compensation gamma reference voltage may be generated based on the second compensation gamma reference voltage.

A gamma reference voltage compensation circuit may include a gamma reference voltage generating unit that generates a gamma reference voltage, and an offset setting unit that sets a plurality of emission signal on-duty ratios based on a duty ratio control signal and that sets each data offset for the emission signal on-duty ratios based on each color shift, the each color shift being caused according to the emission signal on-duty ratios. A plurality of compensation gamma reference voltages may be generated by multiplying the gamma reference voltage by the each data offset for the emission signal on-duty ratios. Further, the compensation gamma reference voltages may be applied to an organic light emitting display (OLED) panel.

The emission signal on-duty ratio may be proportional to a luminance of the OLED panel, and the emission signal on-duty ratio may be controlled by the duty ratio control signal.

The offset setting unit may set a red data offset for a red color, a green data offset for a green color, and a blue data offset for a blue color, respectively.

The red data offset, the green data offset, and the blue data offset may be determined based on a magnitude of the color shift of the red color, a magnitude of the color shift of the green color, and a magnitude of the color shift of the blue color, respectively.

The duty ratio control signal may be applied to a power voltage generating unit, the duty ratio control signal being generated by a duty ratio controlling unit. The power voltage generating unit may provide a power voltage to the OLED panel based on the duty ratio control signal. The OLED panel may display an image based on a data signal during an 'on' period of the power voltage, and may display an image based on a black data during an 'off' period of the power voltage, the black data indicating a black state.

The offset setting unit may set a data offset for a minimum emission signal on-duty ratio among the emission signal on-duty ratios, and may obtain data offsets for the emission signal on-duty ratios by multiplying the data offset for the minimum emission signal on-duty ratio by each constant factor that is inversely proportional to a magnitude of the emission signal on-duty ratio.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
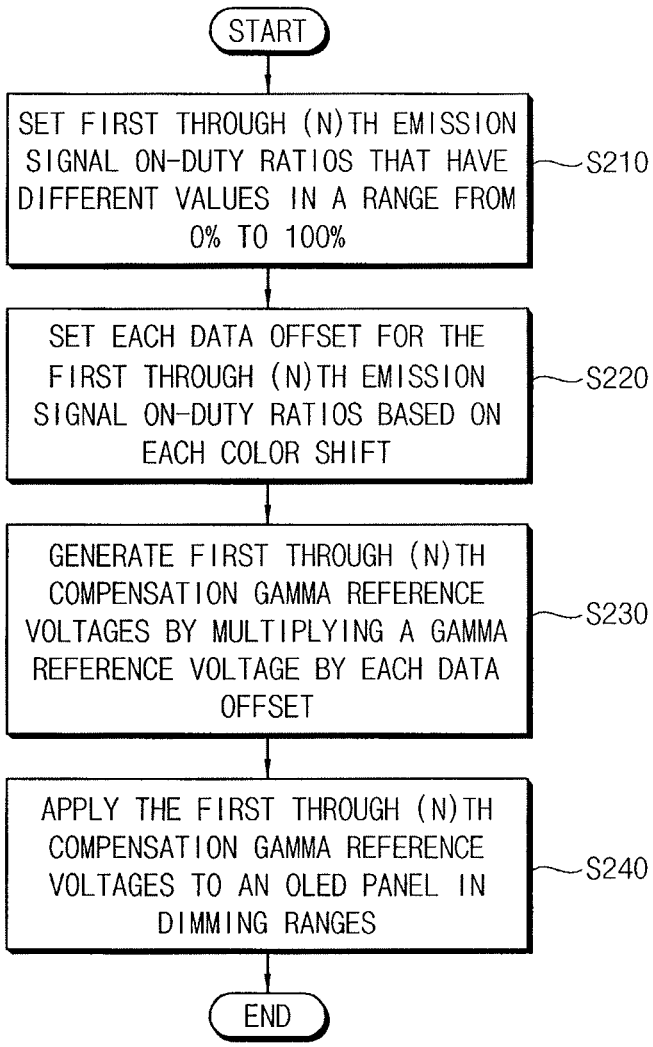
FIG. 1 is a flowchart illustrating a method of compensating gamma reference voltages according to exemplary embodiments.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
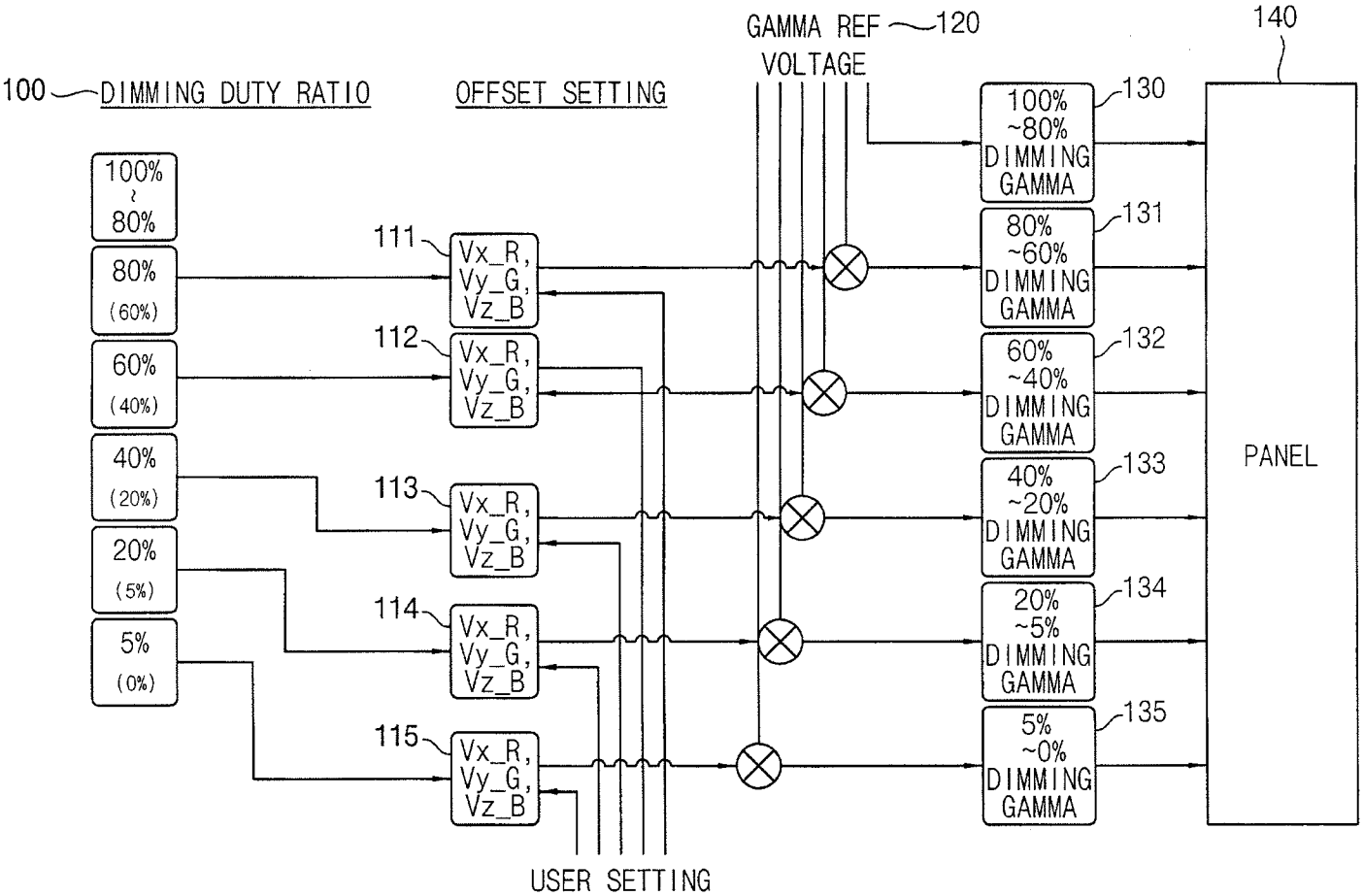
FIG. 2 is a diagram illustrating an example in which gamma reference voltages are compensated by a method of FIG. 1.

FIG. 1 is a flowchart illustrating a method of compensating gamma reference voltages according to example embodiments. FIG. 2 is a diagram illustrating an example in which gamma reference voltages are compensated by a method of FIG. 1.

Referring to FIGS. 1 and 2, a dimming range may be set. A dimming technique may include adjusting an intensity of light by controlling a voltage or an electric power. The dimming technique used in an organic light emitting display (OLED) device may include a resister dimming technique (or, referred to as a data dimming technique), a impulse driving dimming technique, etc. In the resister dimming technique, a level of a data voltage that is applied to each pixel may be controlled to adjust a current flowing through an OLED element. In the impulse driving dimming technique, an emission signal may be controlled to directly adjust a current flowing through the OLED element. For example, the impulse driving dimming technique may achieve a dimming effect by applying a black data among frames (i.e., between adjacent frames) to remove a motion blur. Namely, a luminance may be adjusted by periodically controlling the emission signal to have an 'on' level or an 'off' level.

In one example embodiment, a plurality of emission signal on-duty ratios 100 may be set (Operation S210). The emission signal on-duty ratio 100 may indicate a ratio of an 'on' period of an emission signal to a period corresponding to one frame. For instance, as illustrated in FIG. 2, the emission signal on-duty ratios 100 may be set as 100%, 80%, 60%, 40%, 20%, and 5%. Embodiments are not limited thereto, e.g., the emission signal on-duty ratios may be variously set by users, operators, etc. For example, the emission signal on-duty ratios may be set in increments of 10%, in increasing increments, and/or decreasing increments.

Each data offset 111 through 115 for the emission signal on-duty ratios 100 may be set based on each color shift (i.e., existence and magnitude of each color shift) caused according to the emission signal on-duty ratios 100 (Operation S220). The color shift indicates a color change phenomenon based on conditions. For example, the color shift may indicate that an image is biased toward another particular color as a luminance of a particular color decreases. According to the impulse driving dimming technique, a color shift of a particular color may be caused according to the emission signal on-duty ratios 100.

According to an exemplary embodiment, when a dimming duty ratio is small (i.e., at a low luminance), the color shift of the particular color may be noticeable when the OLED device is driven. Since the color shift is caused (i.e., a luminance of a displayed particular color may be higher than a luminance of a target color by the color shift) at the low luminance, a compensation for decreasing the luminance of the displayed particular color may be required. A relation between the dimming duty ratio and the color shift will be described in detail referring to FIG. 3.

A compensation for decreasing the luminance of the displayed particular color may be used. For example, the data offsets 111 through 115 may be used for multiplying a value less than 1. In one example embodiment, the data offsets 111 through 115 for the emission signal on-duty ratios 100 may be set by users, operators, etc. Each of the data offsets 111 through 115 may have individual values according to a red color, a green color, and a blue color. In addition, each of the data offsets 111 through 115 may have any gradation for each color. For instance, in the case of a data offset 112 for an emission signal on-duty ratio of 60%, Vx_R, Vy_G, and Vz_B indicate a data offset for a red color, a data offset for a green color, and a data offset for a blue color, respectively. In addition, x, y, and z indicate the gradation corresponding to each color, respectively. For instance, the gradation may have 1024 (i.e., equal to 2^10), 256 (i.e., equal to 2^8), or 64 (i.e., equal to 2^6) phases.

In one example embodiment, the data offsets 111 through 115 may be in a form of percentages. For instance, V255_R=−0.98% (i.e., multiplying by 0.9902), V255_G=−1.37% (i.e., multiplying by 0.9863), etc. As described above, the color shift may be greater as the emission signal on-duty ratio 100 is smaller. An absolute value of the data offset may be greater as the color shift is greater. For example, an absolute value of the data offset 115 may be greater than an absolute value of the data offset 113.

After the data offsets 111 through 115 are set, a plurality of compensation gamma reference voltages 131 through 135 may be generated by multiplying a gamma reference voltage 120 by the data offsets 111 through 115 for the emission signal on-duty ratios 100 (Operation S230). Here, voltage levels of the compensation gamma reference voltages 131 through 135 may be smaller than a voltage level of the gamma reference voltage 120 because the data offsets 111 through 115 are used for multiplying a value less than 1. As a result, by the compensation gamma reference voltages, a maximum value of the gamma reference voltage may be reduced. Thus, the color shift (e.g., caused when the displayed luminance is increased) may be compensated. The gamma reference voltage 120 may be generated by a gamma reference voltage generating unit in the OLED device.

According to some exemplary embodiments, the color shift is not compensated in a dimming range from 80% to 100% because a magnitude of the color shift is relatively small. In other example embodiments, however, the color shift may also be compensated in a dimming range from 80% to 100% by applying a proper data offset.

Then, the compensation gamma reference voltages 130 through 135 may be applied to the OLED panel 140 in the dimming ranges that include the emission signal on-duty ratios 100, respectively (Operation S240). In detail, the compensation gamma reference voltages 130 through 135 may be applied to a data driver in a display device, and the data driver may apply a data voltage to the OLED panel 140 based on a data signal having image information, the data voltage indicating a gradation that corresponds to the data signal. As a result, the OLED panel 140 may display an image in which the color shift is eliminated in various dimming ranges. The dimming ranges include the emission signal on-duty ratios 100 for data offset settings, respectively. In addition, each dimming range has a value smaller than or equal to the emission signal on-duty ratio 100 (i.e., a maximum value of each dimming range is the emission signal on-duty ratio 100). For instance, in case of the compensation gamma reference voltage 132 for the emission signal on-duty ratio 100 of 60%, the compensation gamma reference voltage 132 may be applied to the OLED panel 140 in a dimming range from 40% to 60%.

Figure 3:
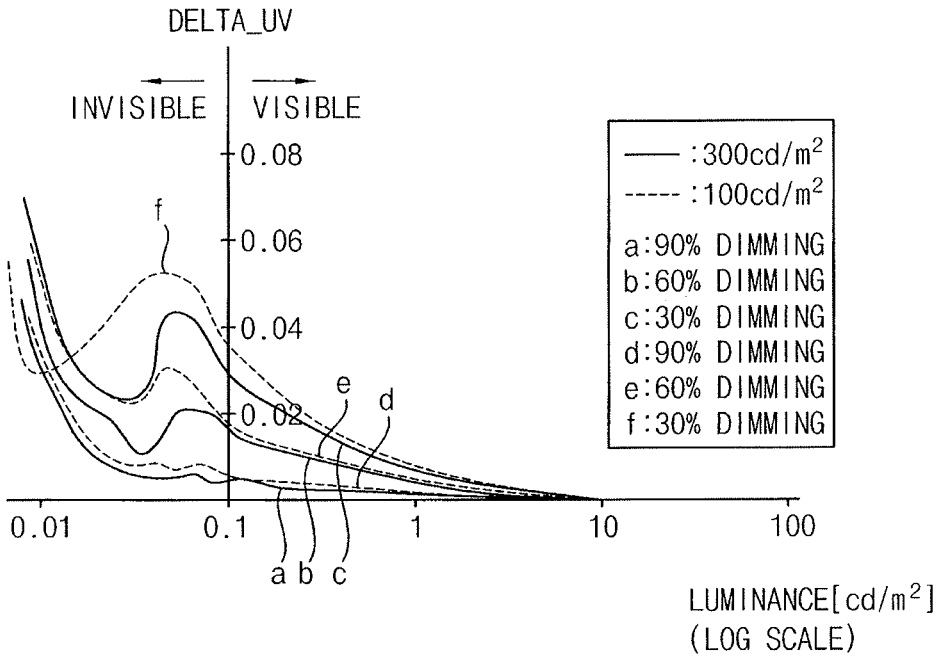
FIG. 3 is a graph illustrating a relation between a dimming duty ratio and a color shift.

FIG. 3 is a graph illustrating a relation between a dimming duty ratio and a color shift.

Referring to FIG. 3, x-axis indicates a gradation that is expressed in a luminance unit (i.e., cd/m$^2$), and y-axis indicates a ratio of the color shift that is caused in a measure object pixel to a target luminance (i.e., an ideal pixel luminance). Values on the x-axis are proportional to a magnitude of a data voltage. The greater values on the y-axis are, the greater the color shift is. With reference to the y-axis, a right region may be only considered because the right region is a visible region, whereas a left region is an invisible region. Meanwhile, graphs (i.e., a, b, and c) indicated as lines are related to emission signal on-duty ratios of 90%, 60%, and 30% at a luminance of 300 cd/m$^2$ as a maximum value, respectively. In addition, graphs (i.e., d, e, and f) indicated as dotted-lines are related to emission signal on-duty ratios of 90%, 60%, and 30% at a luminance of 100 cd/m$^2$ as a maximum value, respectively. As illustrated in FIG. 3, a magnitude of the color shift is irrelevant to a maximum luminance, but is relevant to a dimming duty ratio.

According to exemplary embodiments, the smaller the dimming duty ratio is, the greater the color shift is. That is because a load effect of the OLED panel decreases in an aspect of a pixel-on-rate when the dimming duty ratio is getting smaller (i.e., at a low luminance mode). Thus, compared to the target luminance, greater luminance may be output from the OLED panel. Therefore, as described above, the gamma reference voltage may be compensated for by applying the proper data offset to the gamma reference voltage.

Figure 4:
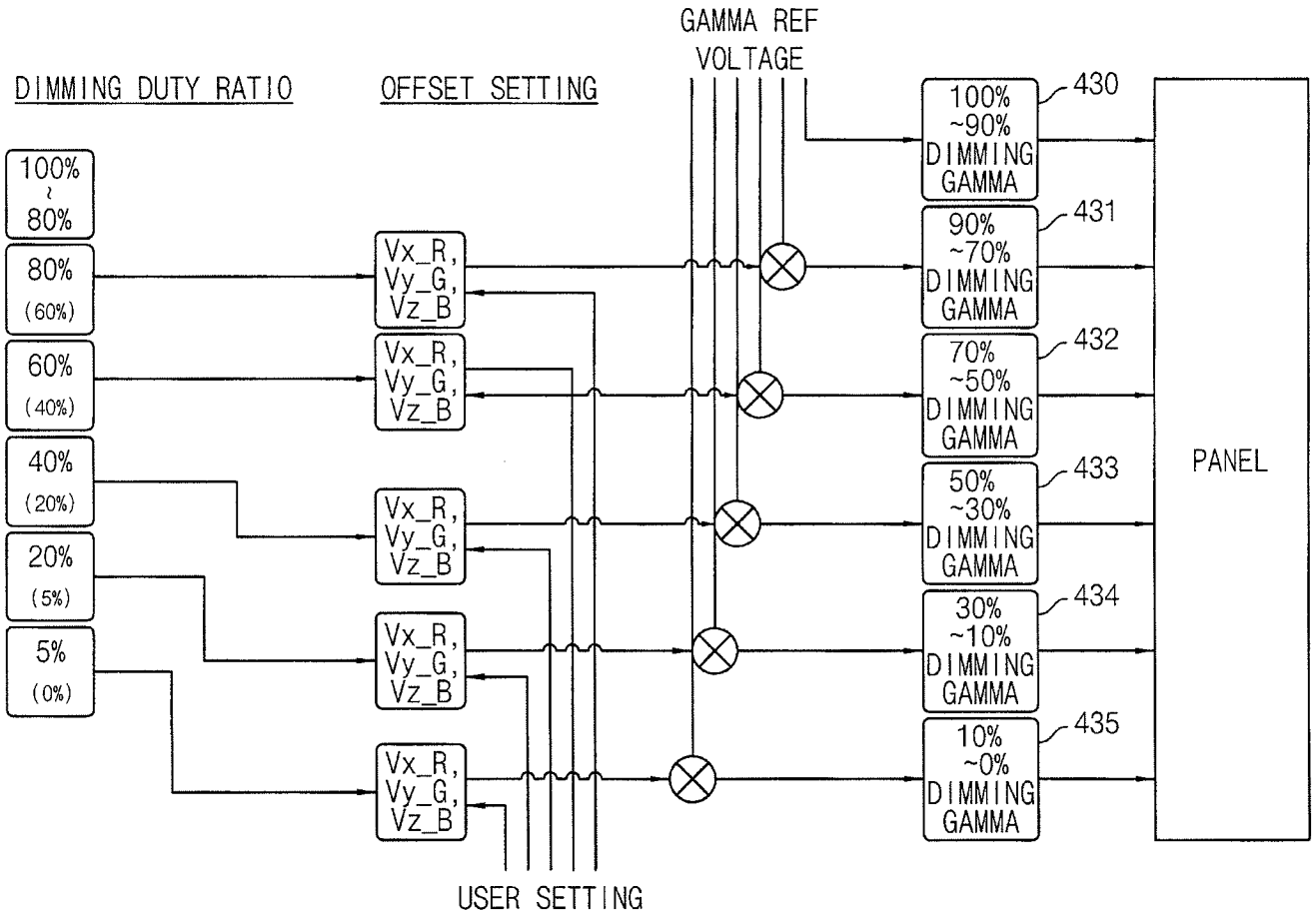
FIG. 4 is a diagram illustrating another example in which gamma reference voltages are compensated by a method of FIG. 1.

FIG. 4 is a diagram illustrating another example in which gamma reference voltages are compensated by a method of FIG. 1. FIG. 4 is substantially similar to FIG. 2 except for the dimming ranges applying compensation gamma reference voltages 430 through 435. Therefore, repeated description of like elements will be omitted.

Referring to FIG. 4, when the compensation gamma reference voltages 430 through 435 are applied, the dimming ranges may be changed in order to fit distribution between cells to a practical value. The dimming ranges may be set to include an emission signal on-duty ratio for data offset settings in the middle of the dimming ranges, respectively. For instance, in case of a compensation gamma reference voltage 432 for an emission signal on-duty ratio of 60%, the compensation gamma reference voltage 432 may be applied to the OLED panel in a dimming range from 50% to 70%.

Figure 5:
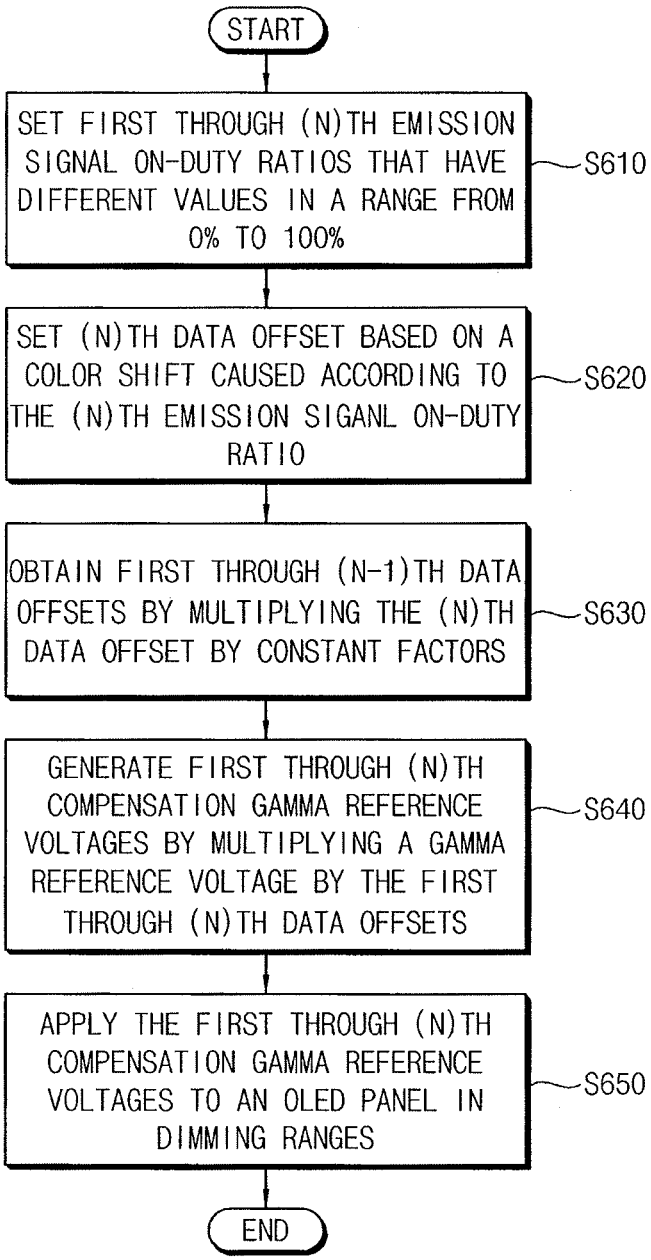
FIG. 5 is a flowchart illustrating a method of compensating gamma reference voltages according to exemplary embodiments.
Figure 6:
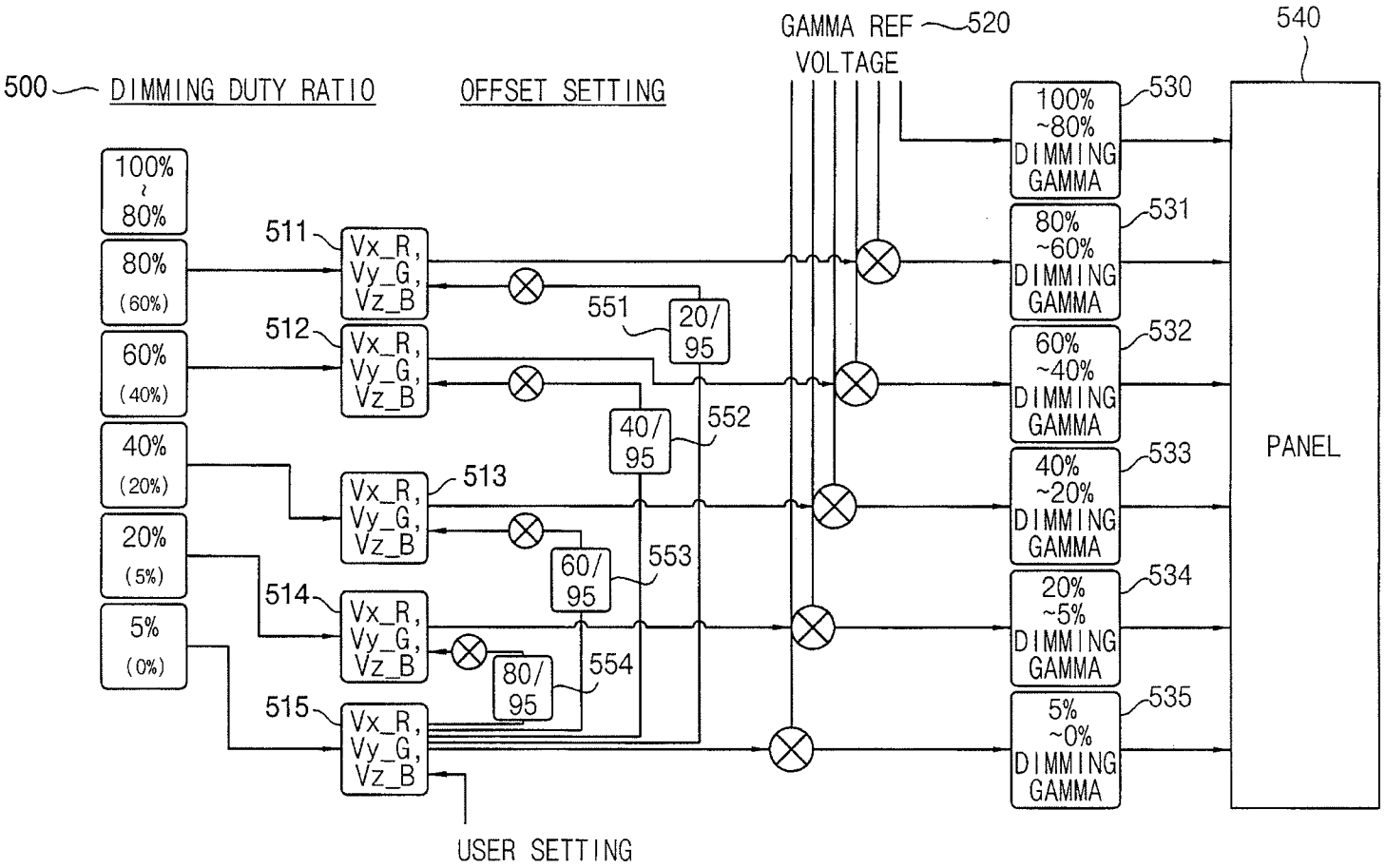
FIG. 6 is a diagram illustrating an example in which gamma reference voltages are compensated by a method of FIG. 5.

FIG. 5 is a flowchart illustrating a method of compensating gamma reference voltages according to example embodiments. FIG. 6 is a diagram illustrating an example in which gamma reference voltages are compensated by a method of FIG. 5.

Referring to FIGS. 5 and 6, first through (n)th (here, n denotes an integer greater than or equal to 1) emission signal on-duty ratios 500 may be set (Operation S610). Here, the first emission signal on-duty ratio is the greatest, and the (n)th emission signal on-duty ratio is the smallest. For instance, as illustrated in FIG. 5, if n is 6, the emission signal on-duty ratios 500 of 100%, 80%, 60%, 40%, 20%, and 5% may be set. However, the emission signal on-duty ratios 500 may be variously set according to users, operators, etc.

A data offset 515 for the (n)th emission signal on-duty ratio may be set based on the color shift (e.g., existence and magnitude of the color shift) that is caused according to the (n)th emission signal on-duty ratio (Operation S620). In an impulse driving dimming technique, a color shift of a particular color may be caused according to the emission signal duty ratio 500. Particularly, in case that the dimming duty ratio is small (i.e., at a low luminance), the color shift of the particular color may be noticeable when the OLED device is driven. Therefore, the data offset 515 that is set in Operation S620 may be the largest among a plurality of data offsets.

Then, data offsets 511 through 514 for first through (n−1)th emission signal on-duty ratios may be obtained based on the data offset 515 for the (n)th emission signal on-duty ratio (Operation S630). In detail, the data offsets 511 through 514 may be obtained by multiplying the data offset 515 by constant factors 551 through 554, the constant factors 551 through 554 being inversely proportional to a magnitude of the emission signal on-duty ratio 500. Each of the constant factors 551 through 554 may be calculated by dividing an emission signal off-duty ratio related to each emission signal on-duty ratio 500 by a maximum emission signal off-duty ratio among a plurality of emission signal off-duty ratios.

For instance, in case of an emission signal on-duty ratio of 60%, an emission signal off-duty ratio may be 40%. Here, since the maximum emission signal off-duty ratio is 95%, the constant factor 552 may be $^{40}/_{95}$. As described above, the smaller the emission signal on-duty ratio 500 is, the greater each constant factor 551 through 554 is. Accordingly, the data offset for a relatively small emission signal on-duty ratio (e.g., the data offset 514) may be relatively great. Therefore, the data offset settings may be easily performed because the data offset is set only for a dimming range in which the greatest color shift is caused, and the data offsets are automatically set for the rest of the dimming ranges.

After the data offsets 511 through 515 are set, a plurality of compensation gamma reference voltages 531 through 535 may be generated by multiplying the gamma reference voltage 520 by the data offsets 511 through 515 for the emission signal on-duty ratios 500, respectively (Operation S640). Since the compensation gamma reference voltages are used, a maximum value of the gamma reference voltage is reduced, so that the color shift may be eliminated. According to some exemplary embodiments, the color shift is not compensated in a dimming range from 80% to 100% because a magnitude of the color shift is relatively small. In other exemplary embodiments, however, the color shift may also be compensated in a dimming range from 80% to 100% by applying a proper data offset.

Then, the compensation gamma reference voltages 530 through 535 are applied to the OLED panel 540 in the dimming ranges that include the emission signal on-duty ratios 500, respectively (Operation S650). In detail, the compensation gamma reference voltages 530 through 535 may be applied to a data driver in a display device, and the data driver may apply a data voltage to the OLED panel 540 based on a data signal having image information, the data voltage indicating a gradation that corresponds to the data signal. As a result, the OLED panel 540 may display an image in which the color shift is eliminated in various dimming ranges.

Figure 7:
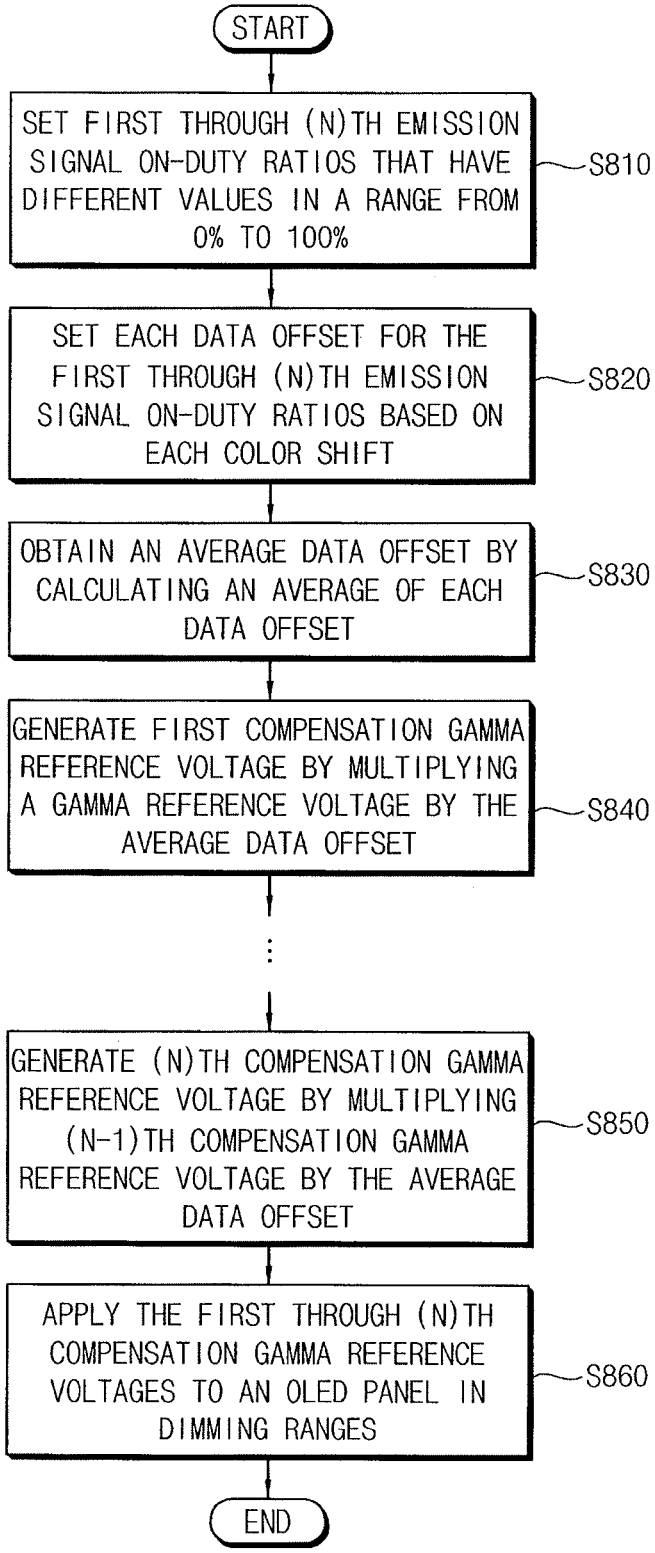
FIG. 7 is a flowchart illustrating a method of compensating gamma reference voltages according to exemplary embodiments.
Figure 8:
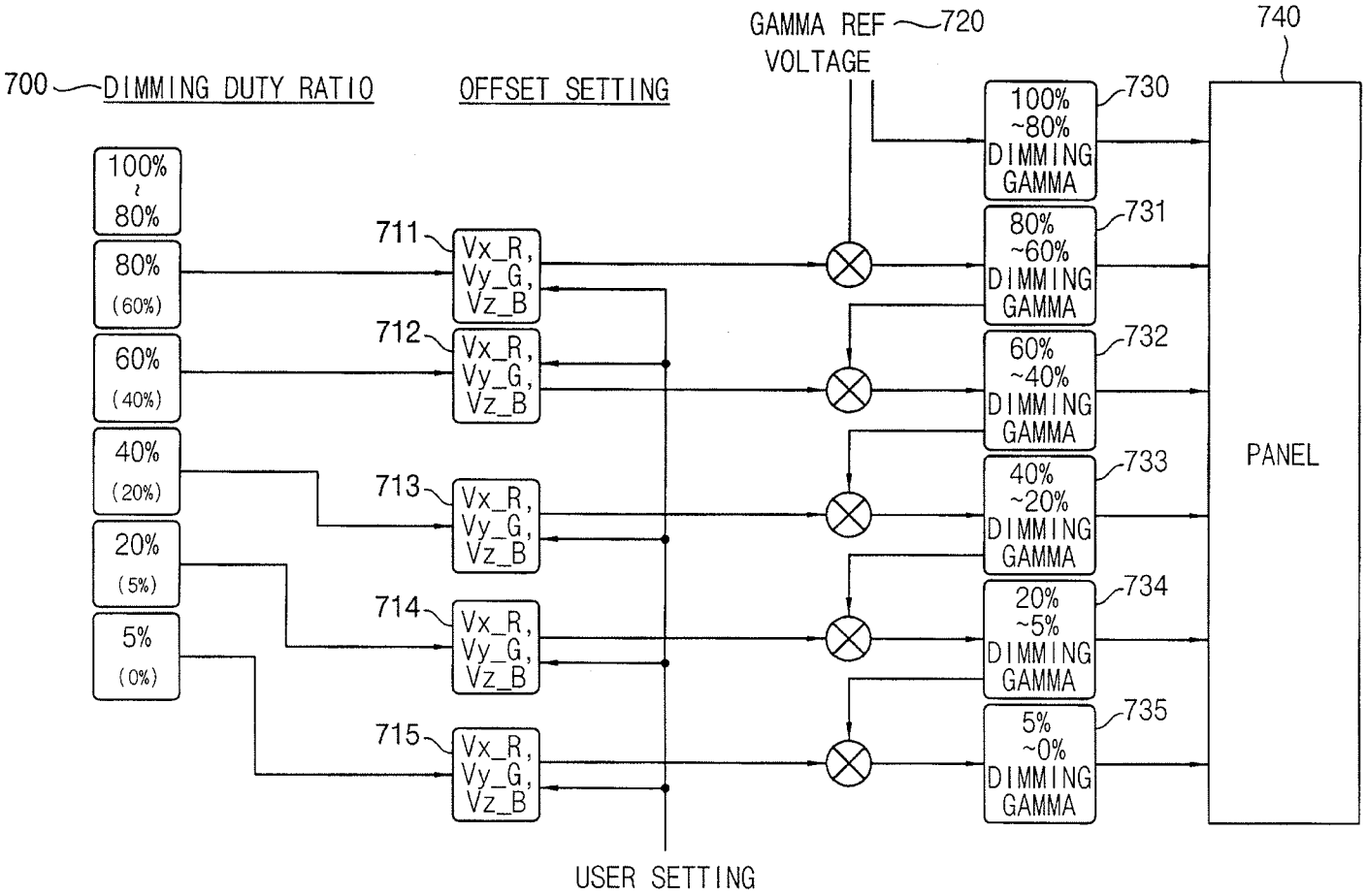
FIG. 8 is a diagram illustrating an example in which gamma reference voltages are compensated by a method of FIG. 7.

FIG. 7 is a flowchart illustrating a method of compensating gamma reference voltages according to example embodiments. FIG. 8 is a diagram illustrating an example in which gamma reference voltages are compensated by a method of FIG. 7.

Referring to FIGS. 7 and 8, first through (n)th (here, n denotes an integer greater than or equal to 1) emission signal on-duty ratios 700 may be set (Operation S810). Here, the first emission signal on-duty ratio is greatest, and the (n)th emission signal on-duty ratio is the smallest. For instance, as illustrated in FIG. 7, if n is 6, the emission signal on-duty ratios 700 of 100%, 80%, 60%, 40%, 20%, and 5% may be set. However, the emission signal on-duty ratios 700 may be variously set according to users, operators, etc.

The data offsets 711 through 715 for the emission signal on-duty ratios 700 may be set based on the color shift (e.g., existence and magnitude of the color shift) that is caused according to the emission signal on-duty ratios 700, respectively (Operation S820).

Then, an average data offset may be obtained by calculating an average of the data offsets 711 through 715 (Operation S830). In one example embodiment, since new compensation gamma reference voltages are sequentially generated by adding an offset to a compensation gamma reference voltage of a previous dimming range. Here, an offset added to a compensation gamma reference voltage may be substantially the same as another offset added to another compensation gamma reference voltage. Thus, the average data offset obtained by calculating an average of the data offsets 711 through 715 may be used as an offset in entire dimming ranges. According to some exemplary embodiments, the average data offset may be individually adjusted according to the color shift in the dimming ranges.

A first compensation gamma reference voltage 731 may be generated by multiplying a gamma reference voltage 720 by the average data offset (Operation S840). Then, a second compensation gamma reference voltage 732 may be generated by multiplying the first compensation gamma reference voltage 731 by the average data offset. Similarly, a plurality of compensation gamma reference voltages may be sequentially generated. Then, a (n)th compensation gamma reference voltage 735 may be generated by multiplying a (n−1)th compensation gamma reference voltage 734 by the average data offset (Operation S850). Since the compensation gamma reference voltages are used, a maximum value of the gamma reference voltage is reduced, so that the color shift may be eliminated.

According to some exemplary embodiments, the color shift is not compensated in a dimming range from 80% to 100% because a magnitude of the color shift is relatively small. According to other exemplary embodiments, however, the color shift may also be compensated in a dimming range from 80% to 100% by applying a proper data offset.

As described above, since new compensation gamma reference voltages are sequentially generated based on a compensation gamma reference voltage of a previous dimming range, error detection and correction may be easily performed.

The compensation gamma reference voltages 730 through 735 are applied to the OLED panel 740 in the dimming ranges that include the emission signal on-duty ratios 700, respectively (Operation S860). In detail, the compensation gamma reference voltages 730 through 735 may be applied to a data driver in a display device, and the data driver may apply a data voltage to the OLED panel 740 based on a data signal having image information, the data voltage indicating a gradation that corresponds to the data signal. As a result, the OLED panel 740 may display an image in which the color shift is eliminated in various dimming ranges.

Figure 9A:
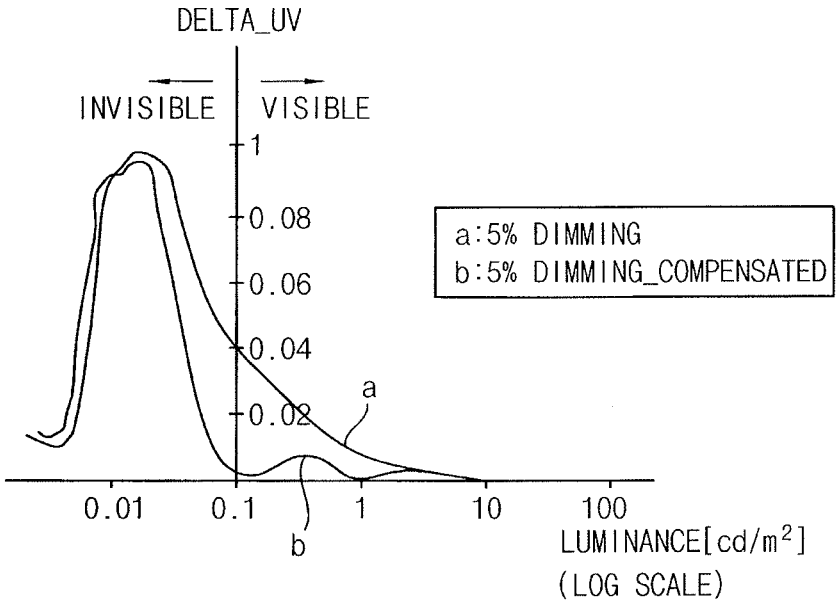
FIGS. 9A and 9B are graphs illustrating an effect achieved by a method of compensating gamma reference voltages according to exemplary embodiments.
Figure 9B:
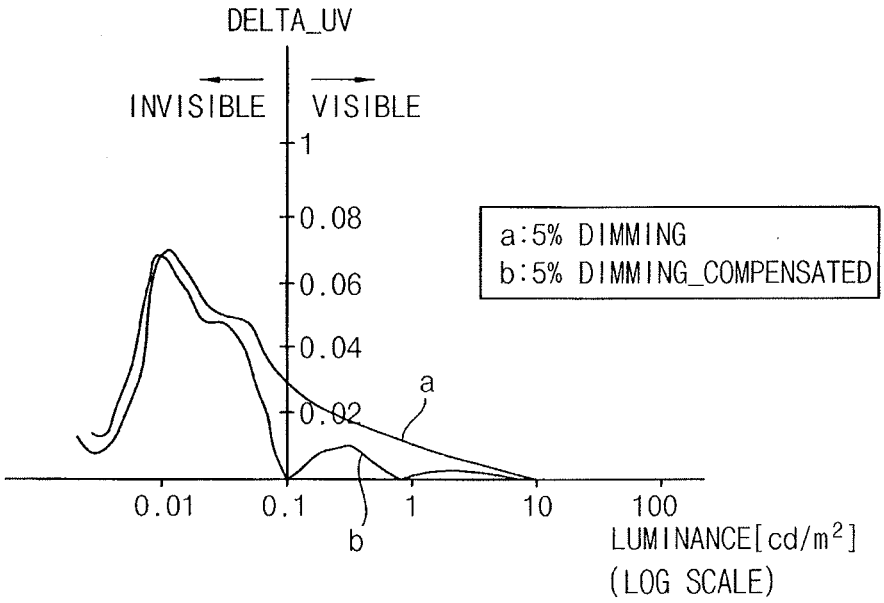

FIGS. 9A and 9B are graphs illustrating an effect achieved by a method of compensating gamma reference voltages according to example embodiments.

Referring to FIGS. 9A and 9B, x-axis indicates a gradation that is expressed in a luminance unit (i.e., cd/m$^2$), and y-axis indicates a ratio of a color shift that is caused in a measure object pixel to a target luminance (i.e., an ideal pixel luminance). Values on the x-axis are proportional to a magnitude of a data voltage. The greater values on the y-axis are, the greater the color shift is. With reference to the y-axis, a right region may be only considered because the right region is a visible region, whereas a left region is an invisible region.

FIG. 9A shows a result generated by selecting an arbitrary cell (i.e., a first cell) to set a data offset, and FIG. 9B shows a result generated by applying the data offset set based on the first cell to another arbitrary cell (i.e., a second cell). Referring to FIG. 9A, a curve (a) indicates a result generated by not compensating the gamma reference voltage at an on-duty ratio of 5%, and a curve (b) indicates a result generated by compensating the gamma reference voltage based on a proper data offset at an on-duty ratio of 5%. In a test, 256 gradations for a red color, and 256 gradations and 32 gradations for a green color are used. Here, the data offset is V255_R of −0.98%, V255_G of −1.37%, and V31_G of −6.09%, respectively. Comparing the curve (a) with the curve (b), it is recognized that less color shift is caused when the gamma reference voltage is compensated compared to when the gamma reference voltage is not compensated.

Referring to FIG. 9B, the curve (a) indicates a result generated by not compensating the gamma reference voltage at an on-duty ratio of 5%, and the curve (b) indicates a result generated by compensating the gamma reference voltage based on the data offset (i.e., V255_R=−0.98%, V255_G=−1.37%, and V31_G=−6.09%) at an on-duty ratio of 5%. It should be understood that the color shift is eliminated (or, reduced) even by applying the data offset to the second cell. Namely, a method of compensating the gamma reference voltage according to example embodiments may eliminate (or, reduce) the color shift for an arbitrary cell. In addition, as indicated by the curve (b) of FIGS. 9A and 9B, a value of Delta_UV is increased by about 0.01 in a luminance range from 0.1 cd/m$^2$ through 1 cd/m$^2$ because a gamma adjustment tab point corresponding to the luminance range from 0.1 cd/m$^2$ to 1 cd/m$^2$ may not exist in a driver IC. Namely, the gamma value adjustment may not be performed in the luminance range from 0.1 cd/m$^2$ to 1 cd/m$^2$.

According to example embodiments, methods of compensating the gamma reference voltage may increase luminance accuracy as an additional effect. As described above, since the displayed luminance at the low luminance mode is higher than the target luminance, the luminance accuracy is lowered. In this case, the compensated gamma reference voltage may be used to decrease a maximum value of the gamma reference voltage. As a result, a luminance increment due to the color shift is decreased, so that the luminance accuracy may be improved. In addition, a gamma curve may not be substantially changed even when the method of compensating the gamma reference voltage is employed. Since a gradation voltage is modified by adding a data offset, a variation of the gamma curve may be caused. Nevertheless, as shown in the test result, the gamma curve may not be substantially changed. That is because a magnitude of the data offset is determined to be not enough to result in a variation of the gamma curve.

Figure 10:
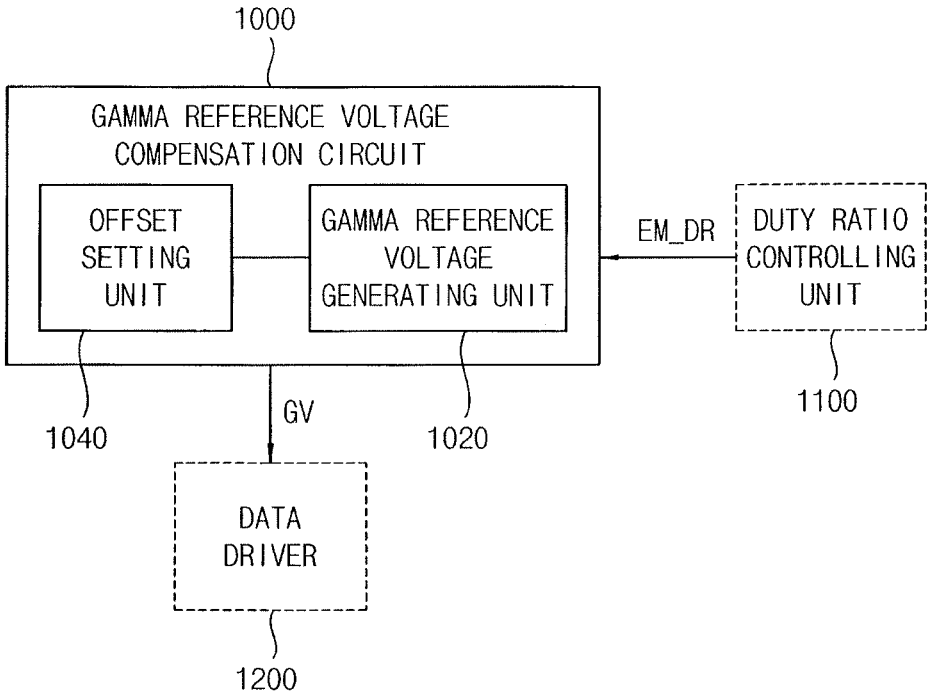
FIG. 10 is a block diagram illustrating a gamma reference voltage compensation circuit according to exemplary embodiments.

FIG. 10 is a block diagram illustrating a gamma reference voltage compensation circuit according to example embodiments.

Referring to FIG. 10, the gamma reference voltage compensation circuit 1000 may include a gamma reference voltage generating unit 1020 and an offset setting unit 1040.

The gamma reference voltage generating unit 1020 generates a gamma reference voltage. The offset setting unit 1040 sets a plurality of emission signal on-duty ratios based on a duty ratio control signal EM_DR that is applied from a duty ratio controlling unit 1100, and sets each data offset for the emission signal on-duty ratios based on each color shift that is caused according to the emission signal on-duty ratios. The gamma reference voltage compensation circuit 1000 generates a plurality of compensation gamma reference voltages GV by multiplying the gamma reference voltage by each data offset for the emission signal on-duty ratios, respectively. Then, the gamma reference voltage compensation circuit 1000 applies the compensation gamma reference voltages GV to a data driver 1200. As a result, the OLED panel that receives the compensation gamma reference voltages GV from the data driver 1200 may display an image in which the color shift is eliminated in various dimming ranges.

Figure 11:
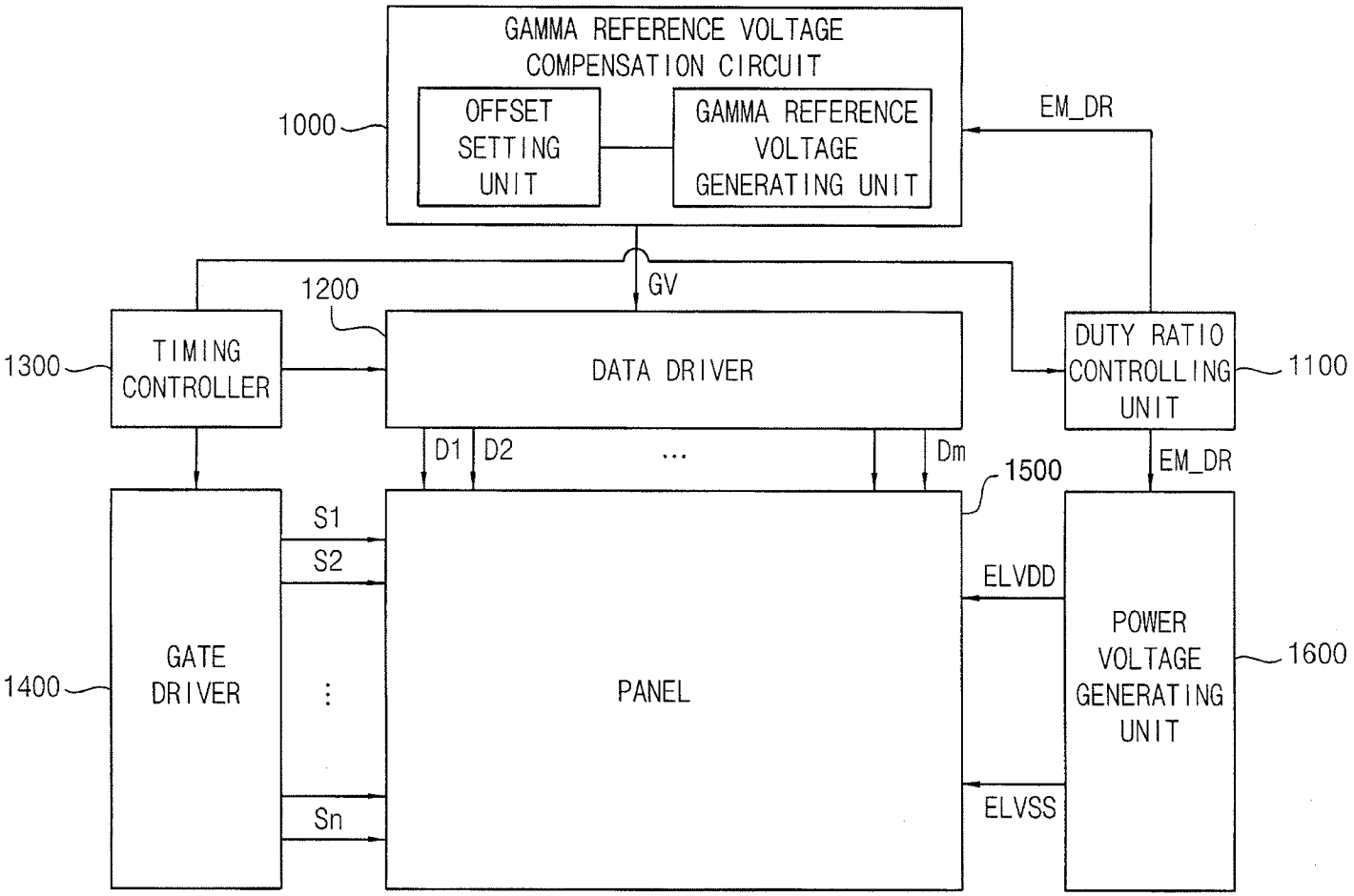
FIG. 11 is a block diagram illustrating a display device including a gamma reference voltage compensation circuit of FIG. 10.

FIG. 11 is a block diagram illustrating a display device including a gamma reference voltage compensation circuit of FIG. 10.

Referring to FIG. 11, the display device 2000 may include a gamma reference voltage compensation circuit 1000, a duty ratio controlling unit 1100, a data driver 1200, a timing controller 1300, a gate driver 1400, an organic light emitting display (OLED) panel 1500, and a power voltage generating unit 1600.

The gamma reference voltage compensation circuit 1000 may set a plurality of emission signal on-duty ratios based on a duty ratio control signal EM_DR that is applied from the duty ratio controlling unit 1100. In addition, the gamma reference voltage compensation circuit 1000 may set each data offset for the emission signal on-duty ratios, and may generate a plurality of compensation gamma reference voltages GV by multiplying the gamma reference voltage by the each data offset, respectively. The data driver 1200 may generate a plurality of data voltages D1 through Dm based on the compensation gamma reference voltages GV received from the gamma reference voltage compensation circuit 1000, and may apply the data voltages D1 through Dm to the OLED panel 1500. Therefore, the OLED panel 1500 may display an image in which the color shift is eliminated in various dimming ranges.

The duty ratio controlling unit 1100 may apply the duty ratio control signal EM_DR to the power voltage generating unit 1600. The power voltage generating unit 1600 may generate a first power voltage ELVDD and a second power voltage ELVSS based on the duty ratio control signal EM_DR. A displayed luminance in the OLED panel 1500 may be controlled by adjusting on-duty ratio of the first power voltage ELVDD and/or on-duty ratio of the second power voltage ELVSS based on the duty ratio control signal EM_DR. For example, the OLED panel 1500 may display an image based on a data signal during an 'on' period of the first power voltage ELVDD, or during an 'on' period of the second power voltage ELVSS. Further, the OLED panel 1500 may display an image based on a black data indicating a black state during an 'off' period of the first power voltage ELVDD, or during an 'off' period of the second power voltage ELVSS. Accordingly, a motion blur that is caused between adjacent frames may be reduced and/or removed.

The gate driver 1400 may generate a plurality of scan signals S1 through Sn to apply the scan signals S1 through Sn to the OLED panel 1500. The timing controller 1300 may control the duty ratio controlling unit 1100, the data driver 1200, and the gate driver 1400.

Figure 12:
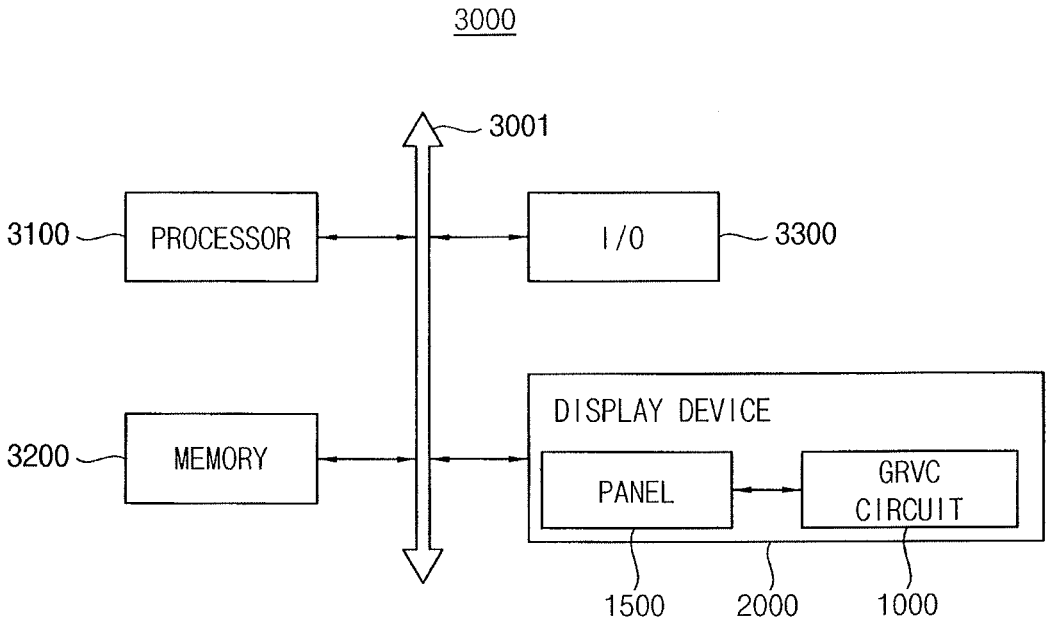
FIG. 12 is a block diagram illustrating an electric device including a display device of FIG. 11.

FIG. 12 is a block diagram illustrating an electric device including a display device of FIG. 11.

Referring to FIG. 12, the electric device 3000 may include a processor 3100, a memory device 3200, an input/output (I/O) device 3300, and a display device 2000.

The processor 3100 may perform various computing functions. For instance, the processor 3100 may be a micro-processor or a central processing unit (CPU). The processor 3100 may be coupled to the memory device 3200 via a bus 3001. The processor 3100 may be coupled to the memory device 3200 and the display device 2000 via an address bus, a control bus, a data bus, etc. In example embodiments, the processor 3100 may be coupled to an extension bus such as a peripheral component interconnects (PCI) bus.

The memory device 3200 may include a volatile memory device such as a dynamic random access memory (DRAM) device, a static random access memory (SRAM) device, etc, and a non-volatile memory device such as an erasable programmable read-only memory (EPROM) device, an electrically erasable programmable read-only memory (EEPROM) device, and a flash memory device, etc. The memory device 3200 may store the software that is performed by the processor 3100.

The I/O device 3300 may be coupled to the bus 3001, and may include input means such as a keyboard, a mouse, etc, and output means such as a printer. The processor 3100 may control operations of the I/O device 3300.

The display device 2000 may be coupled to the processor 3100 via the bus 3001. The display device 2000 may include a gamma reference voltage compensation circuit 1000 and an OLED panel 1500. As described above, the gamma reference voltage compensation circuit 1000 may set a plurality of emission signal on-duty ratios, may set each data offset for the emission signal on-duty ratios, and may generate a plurality of compensation gamma reference voltages by multiplying the gamma reference voltage by the each data offset, respectively. The gamma reference voltage compensation circuit 1000 may apply the compensation gamma reference voltages to the OLED panel 1500 through a data driver. As a result, the OLED panel 1500 may display an image in which the color shift is eliminated in various dimming ranges.

The electric device 3000 may correspond to an electric device having at least one display device 2000 such as a cellular phone, a smart phone, a smart pad, a television, a personal digital assistant (PDA), a MP3 player, a laptop, a desktop computer, a digital camera, etc.

By way of summation and review, a method of controlling a luminance of an OLED panel, e.g., of dimming an OLED device, may include employing an impulse driving function to improve a motion blur phenomenon. However, a color shift of a particular color may occur, e.g., according to a dimming duty ratio.

Accordingly, exemplary embodiments relate to a method of compensating gamma reference voltages capable of eliminating color shifts that are caused according to dimming duty ratios by adding offsets to gamma reference voltages. For example, when an organic light emitting display panel is driven by an impulse driving function, each color shift caused according to dimming duty ratios may be eliminated. Hence, an accuracy of the luminance may be improved.

Example embodiments have been disclosed herein, and although specific terms are employed, they are used and are to be interpreted in a generic and descriptive sense only and not for purpose of limitation. Although a few example embodiments have been described, those of skill in the art that various changes in form and details may be made without departing from the spirit and scope of the present invention as set forth in the following claims. Accordingly, all such modifications are intended to be included within the scope of the embodiments as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of compensating gamma reference voltages, the method comprising:

setting a plurality of emission signal on-duty ratios that have different values in a range from 0% to 100%;

setting a plurality of data offsets for the emission signal on-duty ratios, each of the data offsets being set based on a color shift, the color shift being caused according to the emission signal on-duty ratios;

generating a plurality of compensation gamma reference voltages by multiplying a gamma reference voltage by the data offsets; and applying the compensation gamma reference voltages to an organic light emitting display (OLED) panel in dimming ranges that include the emission signal on-duty ratios, respectively.

2. The method of claim 1, wherein each of the emission signal on-duty ratios is a ratio of an on-period of an emission signal to another period corresponding to one frame, each of the emission signal on-duty ratios being proportional to a luminance of the OLED panel.

3. The method of claim 2, wherein a magnitude of the color shift is greater as the emission signal on-duty ratio is smaller.

4. The method of claim 3, wherein each of the data offsets for the emission signal on-duty ratios includes a red data offset for a red color, a green data offset for a green color, and a blue data offset for a blue color.

5. The method of claim 4, wherein the red data offset, the green data offset, and the blue data offset are determined based on a magnitude of the color shift of the red color, a magnitude of the color shift of the green color, and a magnitude of the color shift of the blue color, respectively.

6. The method of claim 5, wherein the dimming ranges are selected based on the luminance of the OLED panel.

7. The method of claim 6, wherein the emission signal on-duty ratios include a first on-duty ratio and a second on-duty ratio, the second on-duty ratio being smaller than the first on-duty ratio.

8. The method of claim 7, wherein generating the compensation gamma reference voltages includes:

generating a first compensation gamma reference voltage by multiplying the gamma reference voltage by a data offset for the first on-duty ratio, and generating a second compensation gamma reference voltage by multiplying the gamma reference voltage by a data offset for the second on-duty ratio.

9. The method of claim 8, wherein an absolute value of the data offset for the second on-duty ratio is greater than an absolute value of the data offset for the first on-duty ratio.

10. The method of claim 7, wherein setting the data offsets includes:

setting a second data offset for the second on-duty ratio, and obtaining a first data offset for the first on-duty ratio by multiplying the second data offset for the second on-duty ratio by a constant factor that is inversely proportional to a magnitude of at least one of the emission signal on-duty ratios.

11. A gamma reference voltage compensation circuit, comprising:

a gamma reference voltage generating unit that generates a gamma reference voltage; and an offset setting unit that sets a plurality of emission signal on-duty ratios based on a duty ratio control signal, and that sets a plurality of data offsets for the emission signal on-duty ratios, each of the data offsets being based on a color shift, the color shift being caused according to the emission signal on-duty ratios, wherein:

a plurality of compensation gamma reference voltages are generated by multiplying the gamma reference voltage by the data offsets for the emission signal on-duty ratios, and the compensation gamma reference voltages are applied to an organic light emitting display (OLED) panel.

12. The circuit of claim 11, wherein each of the emission signal on-duty ratios are proportional to a luminance of the OLED panel, each of the emission signal on-duty ratio being controlled by the duty ratio control signal.

13. The circuit of claim 12, wherein the offset setting unit sets a red data offset for a red color, a green data offset for a green color, and a blue data offset for a blue color, respectively.

14. The circuit of claim 13, wherein the red data offset, the green data offset, and the blue data offset are determined based on a magnitude of the color shift of the red color, a magnitude of the color shift of the green color, and a magnitude of the color shift of the blue color, respectively.

15. The circuit of claim 14, wherein:

the duty ratio control signal is applied to a power voltage generating unit, the duty ratio control signal being generated by a duty ratio controlling unit, the power voltage generating unit provides a power voltage to the OLED panel based on the duty ratio control signal, and the OLED panel displays an image based on a data signal during an on-period of the power voltage, and displays an image based on a black data during an off-period of the power voltage, the black data indicating a black state.

16. The circuit of claim 11, wherein the offset setting unit sets a data offset for a minimum emission signal on-duty ratio among the emission signal on-duty ratios, and obtains the data offsets for the emission signal on-duty ratios by multiplying the data offset for the minimum emission signal on-duty ratio by a constant factor, the constant factor being inversely proportional to a magnitude of at least one of the emission signal on-duty ratios.

* * * * *